United States Patent [19]

Lesner et al.

[11] 3,987,692

[45] Oct. 26, 1976

[54] TUBE NUT WRENCH

[75] Inventors: Richard S. Lesner, Bloomfield Hills, Mich.; Robert D. Roth, Utica, N.Y.

[73] Assignee: Chicago Pneumatic Tool Company, New York, N.Y.

[22] Filed: June 16, 1975

[21] Appl. No.: 587,221

[52] U.S. Cl. ..... 81/57.13; 81/57.29

[51] Int. Cl.[2] ..... B25B 17/00

[58] Field of Search ..... 81/57.29, 57.30, 58.2, 81/57.13, 57.2, 121 R

[56] References Cited

UNITED STATES PATENTS

| | | | |
|---|---|---|---|
| 429,034 | 5/1890 | Justice | 81/121 R |
| 2,649,823 | 8/1953 | Markovich | 81/58.2 |
| 2,703,221 | 3/1955 | Gardner | 81/57.2 |
| 3,257,877 | 6/1966 | Ulrich et al. | 81/57.13 |

FOREIGN PATENTS OR APPLICATIONS

| | | | |
|---|---|---|---|
| 504,701 | 7/1954 | Canada | 81/58.2 |

*Primary Examiner*—James L. Jones, Jr.
*Attorney, Agent, or Firm*—Stephen J. Rudy

[57] ABSTRACT

A tube nut wrench having a slotted end for application of a socket member of the wrench laterally to a side of a tube so as to receive the latter into the socket and to allow the socket to be moved axially to receive the tube nut for setting the latter. A reversible air motor is used to rotate the socket member in a reverse direction to register a slot in the socket member with a slot in the end of the wrench to admit the tube at the start of an operation, or to allow withdrawal of the wrench from the tube at the end of an operation, the motor being operable in a forward direction to set the nut. An adapter is provided for engagement with the regular socket member to provide a larger socket for reception of a larger than usual size nut.

9 Claims, 12 Drawing Figures

TUBE NUT WRENCH

BACKGROUND OF THE INVENTION

This invention is directed to providing an improved power driven tube nut wrench.

Wrenches of this nature are used in securing the usual hex nut about a tube fitting so as to fix the tube in place. In these cases the ends of the tube are usually not free. A wrench of this kind includes a hex socket member having a radial slot that is registrable with a radial slot in a side of the housing of the tool to admit a tube sideways into the socket member and thereby enable the tool to be moved along the tube toward the hex nut until the latter is received in the socket member. When this is done, torque of a motor is transmitted through a gear train to the socket member to set the nut. It often happens after the nut has been set that the slot of the socket member is displaced angularly and out of register with the slot in the housing, so that it becomes necessary to re-register the slots to enable the tool to be withdrawn from the tube. The means provided for re-registering the slots should be accurate so as to obtain a proper reregistration of the slots, and should be reliable so as to occur with each operation of the tool for this purpose.

Accordingly, a general object of this invention is to provide improved means for re-registering the slots which is accurate in doing so and is reliable for this purpose.

It is also desired in a wrench of this type that the socket element be of a nature in which the nut can be seated and backed by a shoulder so that the wrench will not ride or pass over the nut in applying the wrench to it. Accordingly, it is another object of this invention to provide a socket element having this advantage.

At times a need may arise for use of a socket that is larger than the socket size normally incorporated in the tool in order to apply the wrench to a larger than usual size nut. A feature of the present invention is a socket extender or adapter whereby this need may be fulfilled.

A further object of this invention is to provide a detachable tube nut wrench head which may be marketed as a separable unit for attachment to a conventional nut running tool.

A still further object of this invention is to provide an air powered tool of the foregoing nature having a reversible air motor which may be selectively driven in a forward direction to set the nut, and in a reverse direction to re-register the slotted members when needed. And, it is an object to accomplish the reverse operation without undesirable attendant shock to the parts of the tool, and to do so with accuracy and reliability.

Other objects, features and advantages of this invention will become apparent as this specification develops in greater detail.

In accordance with the invention there is provided a tube nut wrench comprising a housing having a radial slot extending through a side thereof into an opening in the area of a forward end of the housing, a rotatable socket member in the opening having a multi-sided socket in its lower end adapted for reception of a tubing nut, a radial slot extending through the periphery of the socket member into the socket and opening axially through opposite ends of the socket member, a gear formed about the periphery of the socket member, a reversible air motor in the housing, a gear train drivingly connecting the motor with the gear of the socket member, manipulative control means for feeding operating air to the motor to effect rotation of the motor and as a consequence of the socket member in a selected direction, and pawl means having cooperation with the gear train for limiting reverse rotation of the socket member to a position in which its radial slot registers with the radial slot of the housing, the radial slots being adapted when in registered relationship to allow a sideways admission of a tube into the radial slot of the socket member.

DESCRIPTION OF PREFERRED EMBODIMENT

Reference is directed to the accompanying drawing, and now particularly to FIGS. 1–8 wherein is disclosed a power tool for running and setting the usual hex nut on a tube fitting. Only as much of the tool is shown as is needed to provide an adequate understanding of the invention.

Figure 1:
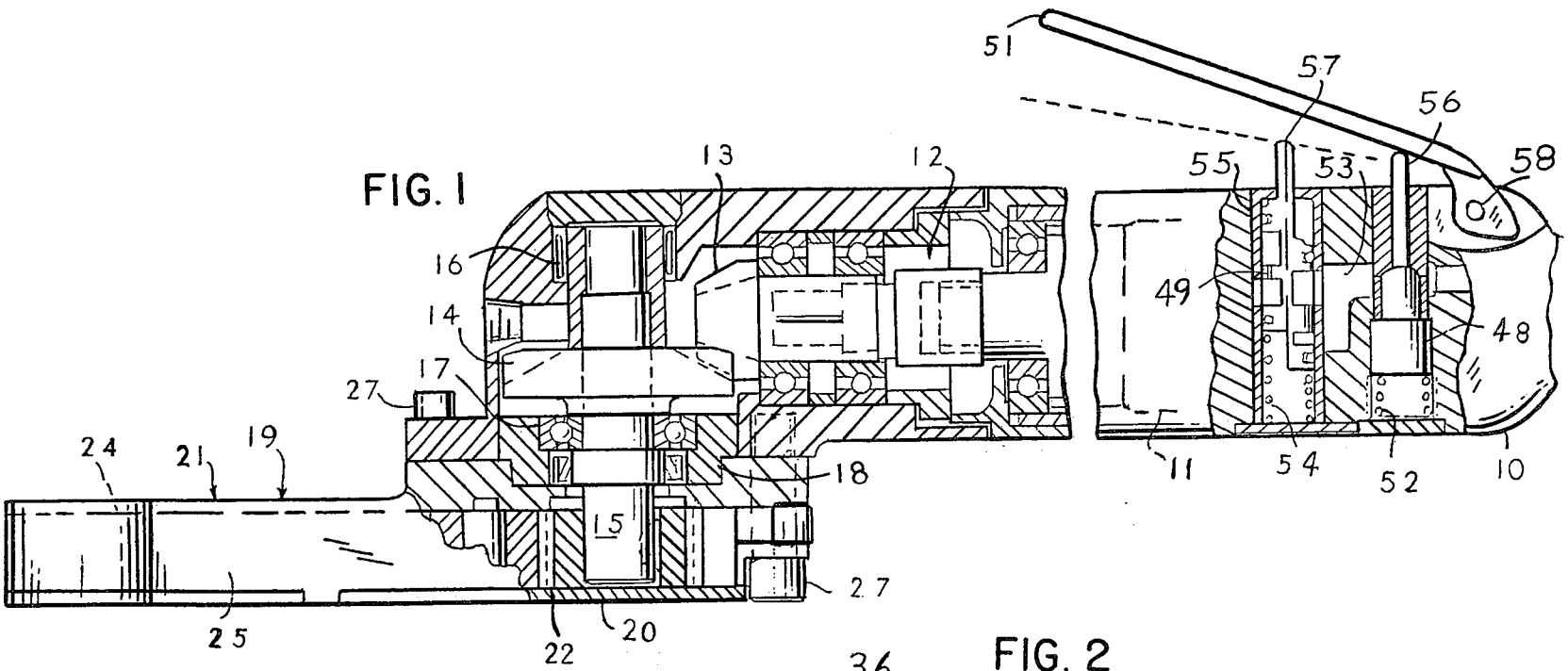
FIG. 1 is a side elevation view partly in longitudinal section showing a tube nut running tool embodying the invention.

In FIG. 1 the tool is shown as including a main housing 10 of linear form. Besides confining within its interior the various components of the tool, the housing serves as a handle for the tool. Supported within the housing is a conventional reversible rotary air motor 11, here of the vane type. The motor is drivingly connected to a train of reduction gearing, generally indicated 12, carrying a bevel gear 13 at its output end.

Gear 13 drivingly engages a mating bevel gear 14 carried by a spindle or stub shaft 15. The latter is supported at right angles to the longitudinal axis of housing 10 for rotation in bearing elements 16 and 17. Bearing 17 is mounted in a bearing ring retainer 18 fitted in an opening at the underside of the housing.

A lower end of shaft 15 projects from the bearing ring retainer out of the main housing 10 into a sub-housing 19 of a wrench head unit, generally designated 21. The latter houses a gear train 22 which serves to transmit drive from shaft 15 to a socket member 23 located in the front end of the wrench head. The socket member is designed for reception of the work, which here would normally be a tube and the usual hex nut (around the tube) that is to be set to secure the tube in place, the tube usually being one the ends of which are engaged or not free.

The wrench head 21 is a separable unit or attachment removably mounted to the forward underside area of the main housing 10. Its housing 19 is in the form of a shallow elongate shell or container provided at its bottom with a cover plate 20 which is readily removable to allow easy access to the various components of the wrench head. The housing 19 includes a top or upper wall 24 from which integrally depends a side wall 25. The cover plate 20, defining a lower wall parallel to the top wall, seats upon the bottom of the side wall and is removably retained thereon by means of screws 26. The rear upper surface of the top wall is thickened so as to accommodate a group of bolts 27 which detachably fasten the wrench head to the forward underside area of the main housing. The upper and lower walls of the wrench head have flat parallel surfaces which extend away from the main housing in a plane parallel to the undersurface of the latter.

An opening extending axially through the upper and lower walls of the wrench head is defined (FIGS. 2, 3) in close proximity to the front end of the latter by a circular hole 28 in the upper wall located coaxially to a circular hole 29 in the lower wall. The socket member 23 is rotatably journalled at its ends in the holes 28, 29.

The wrench head and socket member are designed to allow entry of a work tube through the side wall 25 into the socket member when the wrench head is applied sideways or laterally to a side area of the tube; and to then enable the wrench head to be moved axially relative to the tube to position the socket member over the usual hex nut surrounding the tube for the purpose of setting the nut and securing the tube in place. To this end, the wrench head is formed with a slot 31 (FIG. 2) which extends radially through a side area of the wrench head into the opening defined by holes 28 and 29. The slot cuts through the upper, side, and bottom walls 24, 25 and 20. The socket member is formed with a complementary registrable slot 32 extending radially through its periphery and opening axially through opposite ends of its body. Slot 32 in its upper portion opens through the top end of the socket member; and in its lower portion it is enlarged to define a multi-walled socket 33, here of hex form, opening through the bottom end of the socket member. The socket 33 is of a size adapted to receive the usual hex nut disposed in conventional situations about the work tube for securing the latter in place.

It can be seen from the foregoing structure that, when the slots 31 and 32 respectively in the housing of the wrench head and in the socket member are in register with each other, the wrench head may be applied sideways or laterally relative to a side area of a work tube (not shown) to admit the latter into the socket member; and that after this is done, the wrench head may be moved axially along the work tube to position the socket 33 over the usual hex nut.

Figure 2:
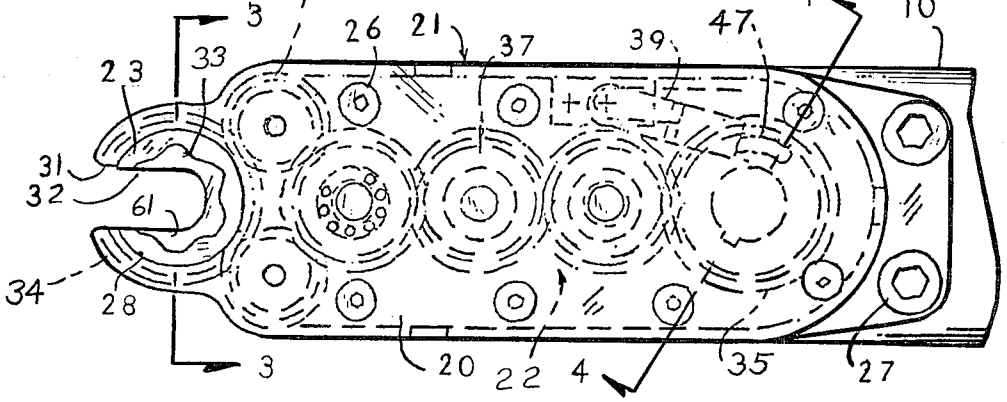
FIG. 2 is a bottom plan view of the wrench head section of the tool, in which view the socket end is shown in its normal open or start position with a slot of the socket registered with a corresponding slot in the wall of the housing of the wrench head for lateral application of the wrench head to a tube and reception of the related securing nut.
Figure 7:
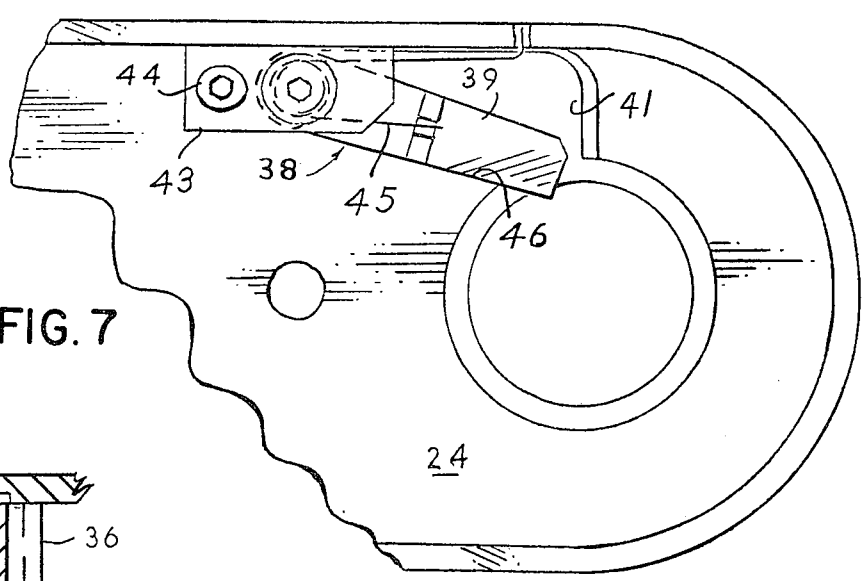
FIG. 7 is a detail in plan showing the location of the pawl detent in a recess formed on the inner surface of the top wall of the housing of the wrench head, the drive gear being omitted from this view.
Figure 4:
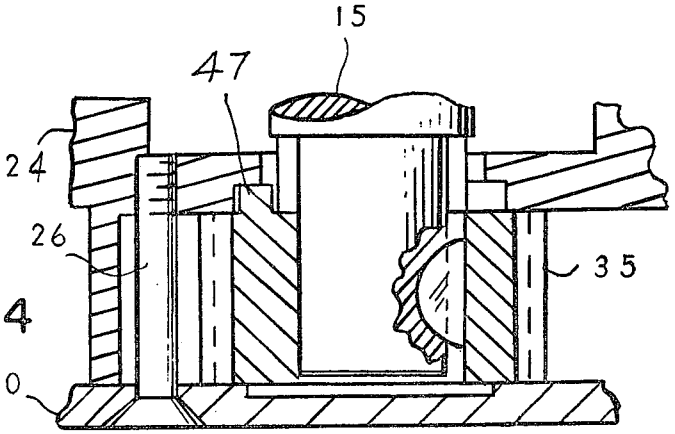
FIG. 4 is a detail in section of the drive gear taken on line 4—4 of FIG. 2.
Figure 5:
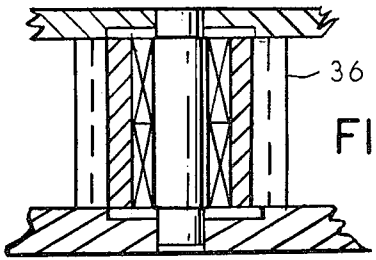
FIG. 5 is a detail in section of an idler gear.
Figure 8:
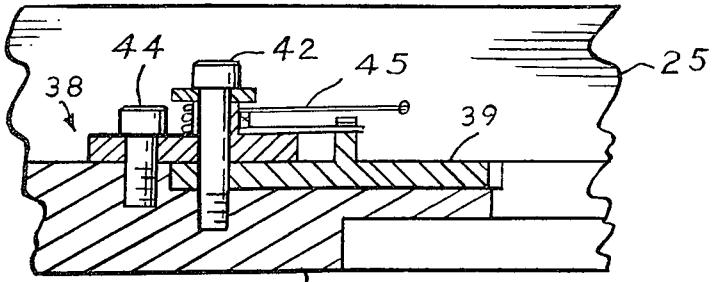
FIG. 8 is a section through the pawl shown in FIG. 7.
Figure 6:
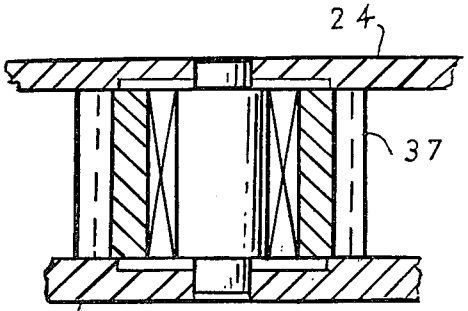
FIG. 6 is a detail in section of an intermediate gear.
Figure 3:
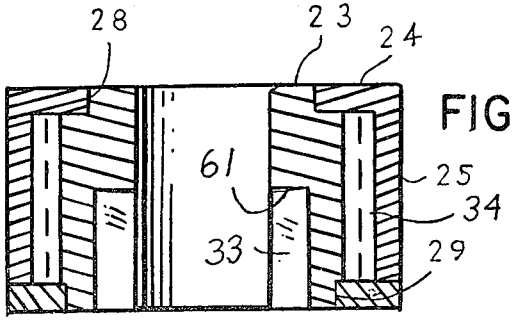
FIG. 3 is a detail in section of the socket member taken on line 3—3 of FIG. 2.

The socket member is formed with a gear toothed periphery 34, as indicated in FIGS. 2 and 4, which is interrupted in its continuity by the slot 32. The geared surface or socket gear 34 is incorporated into the gear train 22 to transmit torque from drive shaft 15 to a hex nut, (not shown) received into the socket.

Gear train 22 (FIGS. 2–6) comprises a drive gear 35 mounted upon the drive shaft 15, a pair of idler gears 36 both normally engaging the socket gear 34, and a succession or series of three intermediate gears 37 drivingly connecting the drive gear with the idler gears. The intermediate and idler gears are rotatably supported upon individual pins mounted at their ends between the upper and lower walls of the wrench head housing.

The forwardly located or final gear of the group of intermediate gears 37 is common to or drivingly engages both of the idler gears 36. The idler gears are spaced laterally apart a distance equal to the lateral dimension or width of the slot 32 of the socket member in such manner that at all times at least one of the idler gears will be in driving engagement with the socket gear. It can be seen by means of this arrangement that normally both idler gears will be engaged with the socket gear, but that one or the other of them will temporarily be out of such engagement during the brief period when the slot in the socket gear is passing over one of the idler gears. Rotation during such period will be transmitted to the socket member by that idler gear remaining in engagement with it.

After the work tube and hex nut have been admitted to the socket member; and after the latter has been driven to set the nut, it can be seen that the socket member may in the process obtain a final position in which its slot 32 is angularly displaced from or out of register with the slot 31 of the wrench head. In this condition, the wrench head may be moved axially along the work tube as needed to free it from the nut, but it cannot because of the displaced slots be moved laterally to free it from the work tube. Accordingly, it will be necessary to return the socket member to a position in which both slots are registered with each other.

Suitable means is provided for bringing the slots 31 and 32 into a registered relationship at any time when needed or desired to permit sideways freeing of the wrench head from, or its application to, a work tube. This need may arise at the start of a work operation or after a nut setting operation, if the slots at either time are angularly displaced from one another. The means for re-registering the slots is provided in part by the capacity of the motor 11 to transmit a reverse rotation through the connecting gearing to the socket member, and in part by detent means, generally designated 38 (FIGS. 7 and 8), that is cooperable with the drive gear 35 to stop reverse rotation of the socket member at the moment the slot 32 of the latter is brought into register with the slot 31 of the wrench head.

The detent means 38 includes a pawl 39 seated in a recessed area 41 of the inner surface of the upper wall 24 of the wrench head. It is pivotable about a pin 42 relative to the upper end of the drive gear 35 (FIG. 2). It is retained for pivotal movement in the recessed area by means of an underlying retaining plate 43, the latter being held in place by means of a screw 44. A spring 45 coiled about the pivot pin 42 having one end anchored to the pawl and its other end anchored to the sidewall of the wrench head biases the pawl clockwise (FIG. 7) into abutment with a side shoulder 46 of the recessed area in such manner that a free end of the pawl projects from an open end of the recess into overlying relation to the end wall of the drive gear, as indicated in FIG. 2. An arcuate lug segment 47, (FIGS. 2, 4) raised upon the end wall of the drive gear is adapted, when the drive gear rotates in a clockwise or positive direction (FIG. 2), to ride over an inner side surface of the pawl so as to brush or cam the pawl aside against the bias of its spring. But, when the drive gear is rotated in a counterclockwise or reverse direction (FIG. 2) an end of the pawl lying in the path of rotation of the lug is cooperable with the lug to arrest or stop the drive gear against further rotation in the reverse direction. When the drive gear is thus stopped, slot 32 in the socket member will be registered with the slot 31 in the wrench head.

A manually operable throttle valve 48 (FIG. 1) and an associated directional flow control valve 49 are incorporated in the main housing to feed operating air to the motor to drive the latter in a selected forward or reverse direction. The throttle valve controls the admission of inlet air from an external source to the tool; and the directional valve controls the application of the admitted air to the forward or reverse side of the motor.

A single manipulative lever 51 is provided for actuating both valves. It is arranged to permit an initial restricted operation of the throttle valve before causing actuation of the directional valve. To this end, the directional and throttle valves are located one forwardly of the other with their vertical axes parallel and lying in the same vertical plane below the lever. The throttle and directional valves are of conventional design.

The throttle valve has a normal at rest position in which its body is biased by a shut-off return spring 52 to a closed condition blocking inlet air flow through the valve to a passage 53 leading to the directional valve. The directional valve has a normal at-rest position (left half of valve, FIG. 1) under the bias of a return spring 54, in which position the inlet passage 53 connects through a bushing 55 of the valve with a passage, not shown, leading through the housing to the reverse side of the motor. The directional valve has a fully depressed condition (right half of valve, FIG. 1) in which the inlet passage 53 is blocked from the reverse side of the motor and is connected through the bushing 55 with a passage, not shown, leading through the housing to the forward side of the motor.

The body of each valve has an externally projecting actuating pin, as indicated at 56, and 57. The actuating lever 51 is pivoted at its rear end 58 to the housing 10; and extends forwardly over the projecting pins of both valves. The throttle valve pin 56 projects externally of the housing and limits in abutment with the underside of the lever. In this normal at-rest condition of the valves, the lever is disposed angularly and clear of the directional valve pin, but overlies the throttle valve pin.

The arrangement of the lever to the actuating pins is such that a partial angular depression of the lever (to the broken line position in FIG. 1) effects a slight depression of, and a consequent partial opening of, the throttle valve without affecting the directional valve. This limited actuation of the lever causes a restricted inlet air flow from the throttle valve to the reverse side of the motor. A consequent slow reverse rotation of the motor is transmitted through the connecting gearing to rotate the socket member in a reverse direction until the lug 47 on the drive gear cooperates with the free end of the pawl 39 to stop further reverse rotation of the socket member. Due to the slow reverse rotation of the motor the cooperation of the lug with the pawl is gentle and without undesirable shock. When the socket member is stopped, the slots 31 and 32 of the wrench head and socket member will be in registered relationship. The tool will then be in condition to receive a work tube sideways into the socket member, and to engage the socket of the latter with the hex nut about the tube. After the work tube is entered into the socket member, the latter is moved axially along the tube until its socket is seated over the hex nut.

To drive the socket member in a forward direction to set and tighten the hex nut received therein, lever 51 is fully depressed about its pivot, causing the throttle valve to open wide, and causing the directional valve to move to a position (right half of valve in FIG. 1) in which air flow to the reverse side of the motor is blocked, and in which the valve connects the inlet passage 53 with the forward side of the motor.

The motor then operates in a forward direction to bring the hex nut to a set or torqued condition, as predetermined by an external pressure regulator not shown located in the supply line, at which time the motor stalls. The operator then releases the control lever 51, and moves the tool axially along the tube as needed to disengage the socket member from the nut. If at this time the slots 31 and 32 are out of register, the operator repeats the initial action of partially depressing the control lever 51 to effect a slow reverse rotation of the socket member and consequent re-registering of the slots so as to permit the wrench head to be laterally drawn clear of the tube.

This arrangement for re-registering the slots of the wrench head and socket member is of decided advantage in a tool of this nature, since the registering action is accurate and reliable.

The particular structure of the socket member is also of desirable advantage in that the socket portion 33 is formed only in its lower portion and does not extend through the opposite end, so that the hex work nut is permitted to seat against a bottom or back shoulder 61 of the socket. This construction allows the operator to exert axial downward pressure on the tool in the direction of the nut without fear of the wrench head passing axially over and free of the nut, as would otherwise happen if the socket portion opened uniformly through both ends of the body of the socket member.

The readily detachable cover plate 20 is of advantage in that it allows, when removed, easy access to the various components of the wrench head for cleaning, replacement or repairs. It is apparent that the socket member may, when needed, be interchanged with socket members having smaller socket portions.

Figure 9:
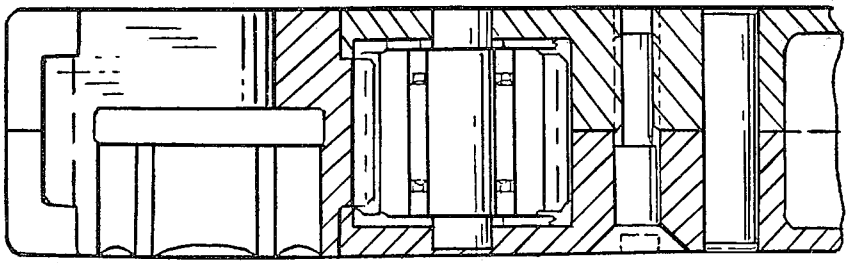
FIG. 9 is a detail in section showing an extended socket adapter member assembled to the regular socket member of the tool.
Figure 9:
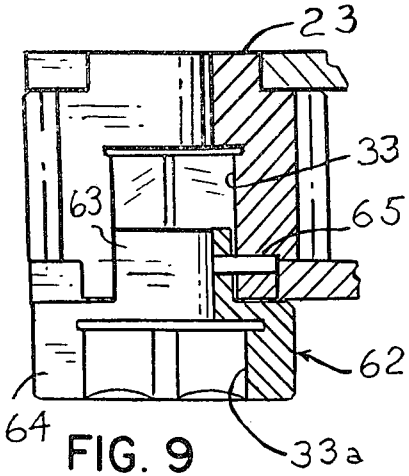

In situations where it is needed to make use of a socket to work on a hex nut of larger size than the socket with which the wrench head would normally be provided, an extended socket member or adapter 62 may be utilized, as indicated in FIG. 9.

The extended socket member includes a body in which the enlarged socket 33*a* is formed. Extending axially upward from the body is a shank or stem 63 of hex configuration adapted to slide fit into the socket 33 of the regular socket member of the tool. The socket 33*a* and stem 63 are provided with a slot 64 which opens radially through the body and stem so as to register or coincide co-planarly with the walls of the slot 32 in the regular socket member. The extended socket member is adapted to be releasably retained to the regular socket member by means of a grub screw or pin, as indicated at 65.

It is understandable that a regular socket member having an enlarged socket portion 33 could be utilized instead of an extended socket member 62, but this would not be desirable in view of the heavy torque that it must sustain and in view of the relatively thinner body wall structure that such an enlarged regular socket member would obtain.

Figure 11:
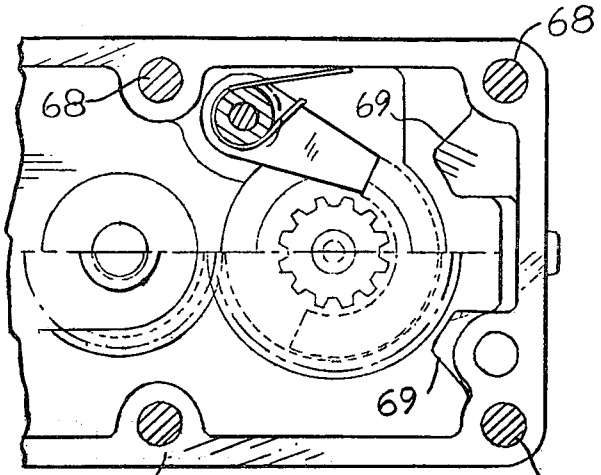
FIG. 11 is a fragmentary detail of the wrench head showing the symmetrical arrangement of the mounting screws, and showing the lugs for retaining the drive gear in its timed meshed relationship.
Figure 12:
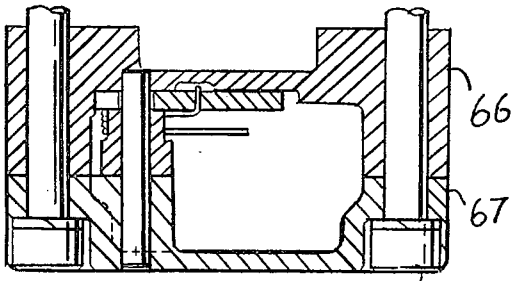
FIG. 12 is a vertical section through FIG. 11 showing the rear mounting bolts.
Figure 10:
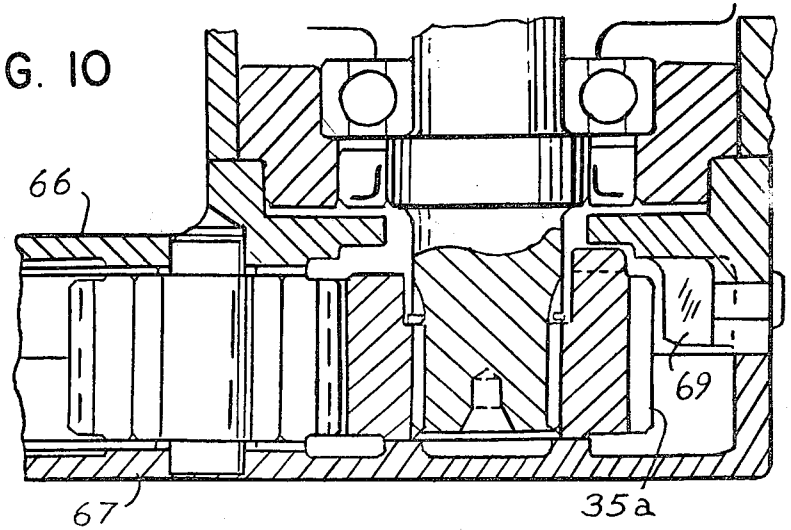
FIG. 10 is a view in longitudinal section of a modification of the wrench head.

Modification (FIGS. 10–12)

A modification of the wrench head is shown in FIGS. 10–12. Its housing comprises a pair of cast mating half-sections 66, 67 bolted separably together.

The modified wrench head housing is bolted at its rear to the underside of the forward end of the main housing by means of four symmetrically arranged bolts 68, FIGS. 11, 12 disposed circumferentially 90° apart. This mounting arrangement is of advantage in that it enables the wrench head to be mounted to the main housing in several selectable directions. It may be mounted so as to extend in a linear direction relative to the main housing as in FIG. 10, or selectively at right angles to its right side or to its left side, thus increasing the utility of the tool.

The modification includes the several gear members of the FIG. 1 form in the gear train of its wrench head, but its drive gear 35*a* is shown as having a slidable spline mounting connection with the stub drive shaft instead of having the keyed connection shown in the FIG. 1 form. This is of advantage in that the drive gear will thereby be contained within the wrench head when the latter is marketed as a separable package or unit. During assembly of the wrench head to the main housing, the drive gear will be slidably slipped on to the splined drive shaft.

The modification further includes means for maintaining the drive gear in its timed engagement with the gear train so that the slots in the socket gear and in the wrench head will obtain a registered relationship when the lug on the drive gear is brought into abutment with the pawl. This means comprises a pair of lugs 69 that are integral with the housing of the wrench head and which extend radially into close proximity to the periphery of the teeth of the drive gear. The close spacing of the lugs to the gear teeth prevents the drive gear from being moved laterally out of engagement from the gear train, as might otherwise accidentally occur should the wrench head be detached from the main housing, or while it is being separably marketed.

What is claimed is:

1. A tube nut wrench comprising a housing having a radial slot extending through a side thereof into an opening in the area of a forward end of the housing, a rotatable socket member in the opening having a multi-sided socket in its lower end adapted for reception of a tubing nut, a radial slot extending through the periphery of the socket member into the socket and opening axially through opposite ends of the socket member, a gear formed about the periphery of the socket member, a reversible air motor in the housing, a gear train drivingly connecting the motor with the gear of the socket member, manipulative control means for feeding operating air to the motor to effect rotation of the motor and as a consequence of the socket member in a selected direction, and pawl means having cooperation with the gear train for limiting reverse rotation of the socket member to a position in which its radial slot registers with the radial slot of the housing, the radial slots being adapted when in registered relationship to allow a side-ways admission of a tube into the radial slot of the socket member (.), wherein the control means comprises a depressible directional flow valve having a spring biased normal position connecting an inlet passage with a reverse side of the motor and having a depressed condition against the bias of the spring connecting the inlet passage with a forward side of the motor, a depressible throttle valve spaced linearly rearwardly of the directional flow valve and having a spring biased normal position blocking an operating air supply passage off from the inlet passage, and a single lever pivoted to the housing in an overhead relationship to both valves, the lever being manipulative to a first position relative to the throttle valve to depress the latter to a restricted open condition allowing a restricted operating air flow through the inlet passage and the directional flow valve to the reverse side of the motor, and the lever being manipulative to a second position relative to both valves to simultaneously depress the throttle valve to a fully open condition and to depress the directional valve from its normal position to a fully open condition allowing operating air flow from the throttle valve to the inlet passage to pass to the forward side of the motor.

2. A tube nut wrench, as in claim 1, wherein the housing comprises a linear section defining a handle for the operator of the wrench.

3. A tube nut wrench as in claim 1, wherein the housing comprises a linear section, and a head section offset from and co-extensive with the linear section in which head section the socket member is rotatably supported.

4. A tube nut wrench as in claim 3, wherein the gear train comprises an output spindle, a first gear train section housed in the linear section of the housing drivingly connecting the motor with spindle, and a second gear train section housed in the head section drivingly connecting the spindle with the gear of the socket member.

5. A tube nut wrench as in claim 4, wherein the spindle projects from the linear section of the housing at right angles to the longitudinal axis of the latter into the head section, and the second gear train includes a drive gear mounted upon the spindle within the head section of the housing.

6. A tube nut wrench as in claim 5, wherein a lug segment projects from an end of the drive gear, and the pawl means is cooperable with the lug in limiting the reverse rotation of the socket member.

7. A tube nut wrench as in claim 6, wherein the head section is removably bolted to the linear section, the bolts being arranged symmetrically and spaced circumferentially equally apart from each other, permitting mounting of the head section to the linear section in selectable angularly displaced positions all lying in the same plane.

8. A tube nut wrench as in claim 7, wherein the drive gear is slidably splined upon the spindle, the pawl means includes a pawl disposed in overlying relation to the drive gear blocking axial displacement of the drive gear relative to the head section of the housing, and lug elements projecting radially from the head section of the housing into close proximity to the periphery of the drive gear block the latter against lateral displacement from its engagement with the second gear train upon withdrawal of the spindle from the drive gear and removal of the head section from the linear section.

9. A tube nut wrench as in claim 1, wherein each of the valves has an actuating pin porjecting from the housing, and the lever extends angularly forwardly in overhead relation to both of the actuating pins, the lever having a normal at rest position in contact with the actuating pin of the throttle valve and clear of the reverse valve.

* * * * *